US008967743B2

(12) United States Patent
Bernett et al.

(10) Patent No.: US 8,967,743 B2
(45) Date of Patent: Mar. 3, 2015

(54) FURNITURE COMPONENT WITH FLOATING TOP

(75) Inventors: Jeffrey Bernett, New York, NY (US); Nicholas Dodziuk, New York, NY (US); Paul S. Gartland, Holland, MI (US); Scott G. Ball, Hudsonville, MI (US); Jeffrey Allen Book, Holland, MI (US); Eileen M. LaMore, Grand Haven, MI (US); Jeffrey Jay Weirsma, Hudsonville, MI (US); Bruce A. Wilcox, North Shores, MI (US)

(73) Assignee: Herman Miller, Inc., Zeeland, MI (US)

( * ) Notice: Subject to any disclaimer, the term of this patent is extended or adjusted under 35 U.S.C. 154(b) by 130 days.

(21) Appl. No.: 13/156,714

(22) Filed: Jun. 9, 2011

(65) Prior Publication Data

US 2011/0304251 A1 Dec. 15, 2011

Related U.S. Application Data

(60) Provisional application No. 61/353,533, filed on Jun. 10, 2010.

(51) Int. Cl.

| | |
|---|---|
| ***A47B 29/00*** | (2006.01) |
| ***A47B 47/04*** | (2006.01) |
| ***A47B 17/00*** | (2006.01) |

(52) U.S. Cl.

CPC ..... *A47B 47/04* (2013.01); *A47B 17/00* (2013.01)

USPC ..... 312/265.6

(58) Field of Classification Search

CPC ..... A47B 47/03; A47B 47/04; A47B 69/00; A47F 5/005

USPC ..... 312/257.1, 263, 264, 265.5, 265.6, 312/140.2, 140.3

See application file for complete search history.

(56) References Cited

U.S. PATENT DOCUMENTS

| | | | | |
|---|---|---|---|---|
| 1,582,806 | A | | 4/1926 | Videtta |
| 1,755,062 | A | | 4/1930 | Hernes et al. |
| 2,063,725 | A | * | 12/1936 | Clark ..... 312/107 |
| 2,582,791 | A | | 1/1952 | Page |
| 3,479,102 | A | | 11/1969 | Wallach et al. |
| 3,619,018 | A | | 11/1971 | Wallach |
| 4,271,566 | A | * | 6/1981 | Perina ..... 24/442 |
| 4,317,416 | A | | 3/1982 | Baum et al. |

(Continued)

OTHER PUBLICATIONS

Office furniture.com [online] [retrieved from internet: URL http://computer-desks.officefurniture.com/Soho-Dougle-Pedestal-Desk-STQ-AQ12-6063.a...], [retrieved on May 27, 2010], 3 pages.

(Continued)

*Primary Examiner* — Matthew Ing

(74) *Attorney, Agent, or Firm* — Brinks Gilson & Lione

(57) ABSTRACT

A furniture component includes a base having a back wall with a first outer vertical face, a first inner vertical face and a first upper edge. A pair of horizontally spaced apart side walls each have a second outer vertical face, a second inner vertical face and a second upper edge. The first and second upper edges are substantially coplanar. An outer top includes a bottom surface spaced above the first and second upper edges and defines a visible gap therebetween. The outer top has a rear edge and a pair of horizontally spaced apart side edges. The rear edge and the first outer vertical face are substantially coplanar, and the side edges and second outer vertical faces are substantially coplanar. A method of assembling and using the furniture component are also provided.

20 Claims, 4 Drawing Sheets

(56) References Cited

U.S. PATENT DOCUMENTS

| | | | | |
|---|---|---|---|---|
| 4,337,709 | A | 7/1982 | Nicholson | |
| 4,389,948 | A * | 6/1983 | Sands et al. | 109/82 |
| 4,451,711 | A * | 5/1984 | Jackson | 381/335 |
| 4,632,040 | A | 12/1986 | Sheffer | |
| 4,895,418 | A | 1/1990 | Medellin et al. | |
| 5,125,348 | A * | 6/1992 | Horwitz | 108/180 |
| 5,130,494 | A | 7/1992 | Simnton et al. | |
| 5,394,658 | A | 3/1995 | Schreiner et al. | |
| 5,402,738 | A | 4/1995 | Carr et al. | |
| 5,584,549 | A * | 12/1996 | Lybarger et al. | 312/265 |
| 5,967,060 | A | 10/1999 | Savoie | |
| 5,974,742 | A | 11/1999 | Schreiner et al. | |
| 6,028,293 | A * | 2/2000 | Nagle et al. | 219/432 |
| 6,123,031 | A | 9/2000 | Hayman-Chaffey | |
| 6,237,881 | B1 | 5/2001 | Levesque | |
| 6,530,097 | B1 * | 3/2003 | Sung | 4/631 |
| 6,536,357 | B1 | 3/2003 | Hiestand | |
| 6,631,603 | B2 | 10/2003 | Zornes | |
| 6,659,021 | B2 | 12/2003 | Wen | |
| 6,691,342 | B2 | 2/2004 | Sherman | |
| 6,725,784 | B2 | 4/2004 | Crinion | |
| 6,739,153 | B2 | 5/2004 | Davies et al. | |
| 6,877,824 | B2 | 4/2005 | Winkless | |
| 6,883,880 | B2 * | 4/2005 | Flores | 312/140.4 |
| 7,066,097 | B2 | 6/2006 | Gayhart et al. | |
| 7,249,745 | B2 | 7/2007 | Moore et al. | |
| 7,415,933 | B2 | 8/2008 | Sagol | |
| 7,458,689 | B2 | 12/2008 | Head et al. | |
| 7,562,949 | B1 | 7/2009 | Nielsen | |
| 7,640,870 | B2 | 1/2010 | Strong et al. | |
| 7,703,398 | B2 | 4/2010 | Brauning et al. | |
| 2003/0173878 | A1 * | 9/2003 | Youngs et al. | 312/257.1 |
| 2004/0150306 | A1 * | 8/2004 | Steedly | 312/409 |
| 2005/0204968 | A1 | 9/2005 | Butkus et al. | |
| 2006/0132003 | A1 | 6/2006 | Kelley et al. | |
| 2007/0284973 | A1 | 12/2007 | Jones | |
| 2008/0224578 | A1 | 9/2008 | Irmer et al. | |
| 2008/0282942 | A1 | 11/2008 | Hawkins | |
| 2009/0218920 | A1 | 9/2009 | Venturini et al. | |

OTHER PUBLICATIONS

Metro Modern, George Nelson Floating Top Desk, [online] [retrieved from the internet: URL http://metromodern.biz/George-Nelson-Floating-Top-Desk-2.html], [retrieved on May 27, 2010], 2 pages.

* cited by examiner 84
10
82
86
2
12
84
4
22
8
22
20
6

10
4
24
6
10
4
26
60
6

10
22

22
4
64

FURNITURE COMPONENT WITH FLOATING TOP

This application claims the benefit of U.S. Provisional Application No. 61/353,533, filed Jun. 10, 2010, the entire disclosure of which is hereby incorporated herein by reference.

FIELD OF THE INVENTION

The present invention relates generally to a furniture component, and in particular, to a furniture component having a floating top, together with methods for the use and assembly thereof.

BACKGROUND

Furniture components, such as desks and cabinets, are typically configured with a top. Often, it is desirable to provide a furniture component with a top that lies flush with the outer faces of the furniture component. This may present various manufacturing and assembly problems, however, because tolerance build-ups, dimensional stability, etc., may present various fit and finish problems, especially at the corners of the furniture component.

In some instances, the top may be elevated above a base structure to provide a "floating" appearance. Typically, however, the base structure is still configured with a top positioned below the floating top, with the top of the base structure presenting the same problems just discussed. In other instances, the floating top extends past the sides of the base, which may aid in obscuring the fit problems, but does not provide a clean profile for the furniture component and presents an extended edge that may be snagged or otherwise impacted. Such an extended top may also further limit the fit and aesthetics of the component when disposed against other components or walls.

SUMMARY

The present invention is defined by the following claims, and nothing in this section should be considered to be a limitation on those claims.

In one aspect, one embodiment of a furniture component includes a base having a back wall with a first outer vertical face, a first inner vertical face and a first upper edge. Each of a pair of horizontally spaced apart side walls have a second outer vertical face, a second inner vertical face and a second upper edge. A front wall includes a third outer vertical face and an third upper edge. At least the first and second upper edges are substantially coplanar. An inner support is connected to at least one of the back wall and/or the side walls. An outer top is supported by the inner support and includes a bottom surface spaced above the first and second upper edges and defines a visible gap therebetween. In one embodiment, the outer top and inner support are integrally formed. The outer top has a rear edge, a pair of horizontally spaced apart side edges and a front edge. The rear edge and the first outer vertical face are substantially coplanar, while the side edges and corresponding ones of the second outer vertical faces are also substantially coplanar.

In another aspect, one embodiment of the furniture component is configured with the third upper edge being substantially coplanar with the first and second upper edges. In addition, the third outer vertical face may be substantially coplanar with the front edge.

In yet another aspect, a method of assembling a furniture component includes connecting a back wall to a pair of horizontally spaced side walls, wherein the back wall includes a first outer vertical face, a first inner vertical face and a first upper edge, wherein each of the side walls includes a second outer vertical face, a second inner vertical face and a second upper edge, and wherein the first and second upper edges are substantially coplanar. The method further includes connecting an inner top to the back wall and the side walls such that an upper surface of the inner top is vertically spaced above the first and second upper edges. The method further includes supporting an outer top on the inner top wherein a bottom surface of the outer top is spaced above the first and second upper edges and defines a visible gap therebetween. A rear edge of the outer top is substantially coplanar with the first outer vertical face and a pair of horizontally spaced apart side edges of the outer top are substantially coplanar with the second outer vertical faces.

The various embodiments of the furniture component, and methods for the assembly and use thereof, provide significant advantages over other workstations. For example and without limitation, the furniture component has a clean, furniture component visual, with the various components lying substantially flush. At the same time, the gap conceals the various fit-up issues, for example at the corners. This in turn eases and facilitates the assembly process.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "longitudinal," as used herein means of or relating to length or the lengthwise direction, for example from one side of a top to the other side thereof. The term "lateral," as used herein, means situated on, directed toward or running from side to side. The term "coupled" means connected to or engaged with whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first edge may be the same as a second edge, with each simply being applicable to different components.

Figures 1A, 1B, 1C, 1D:
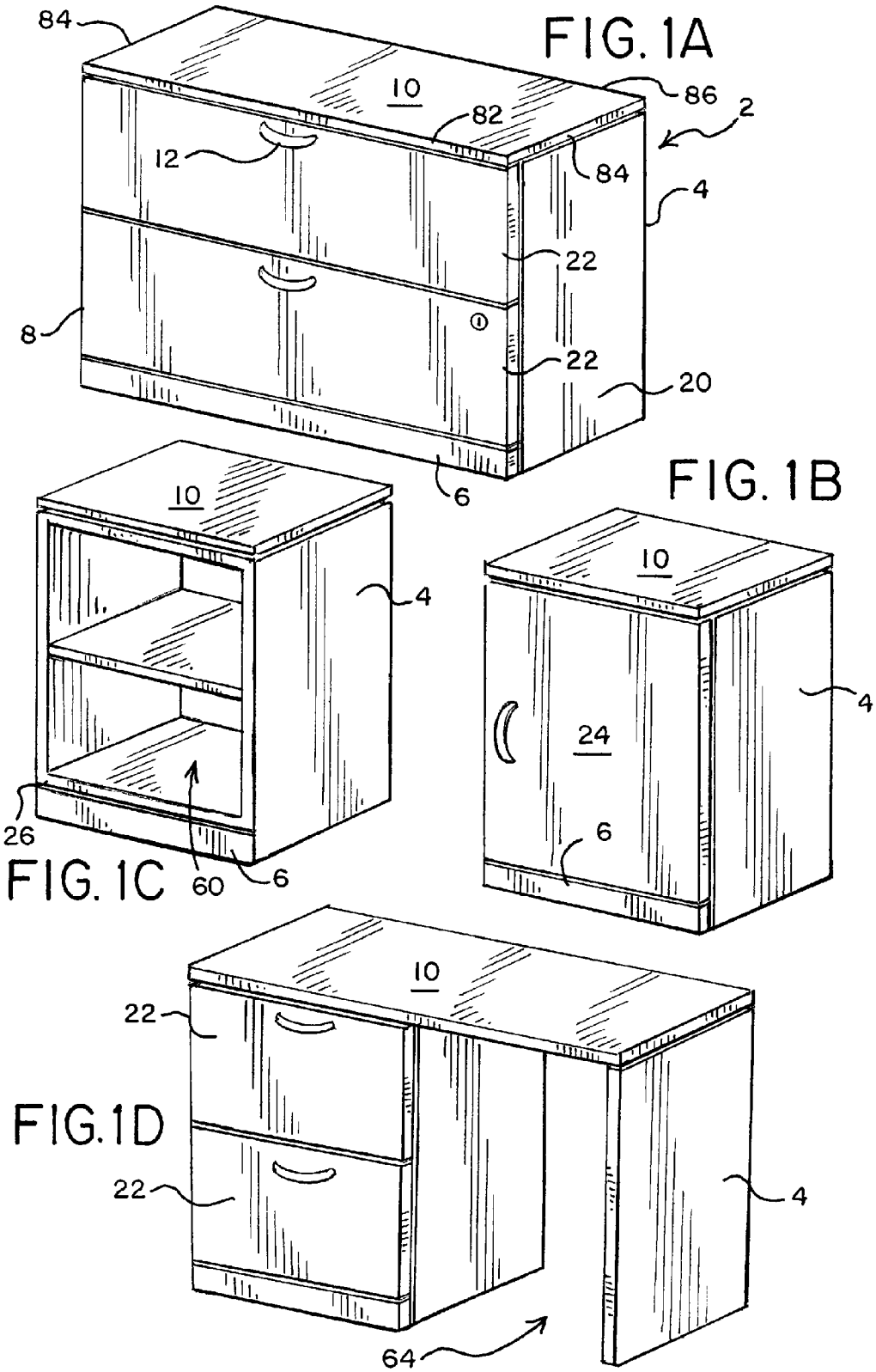
FIG. 1A is a front/top perspective view of one embodiment of a furniture component configured with a pair of drawers.
FIG. 1B is a front/top perspective view of one embodiment of a furniture component having a door.
FIG. 1C is a front/top perspective view of one embodiment of a furniture component having a peripheral frame.
FIG. 1D is a front/top perspective view of one embodiment of a furniture component configured as a desk.
Figure 2:
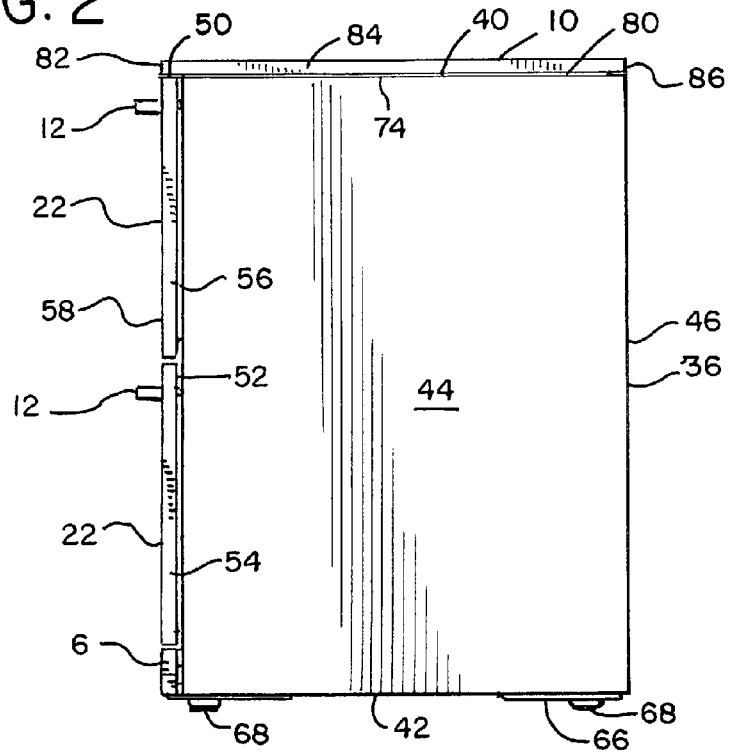
FIG. 2 is a side view of the furniture component shown in FIG. 1A.
Figure 3:
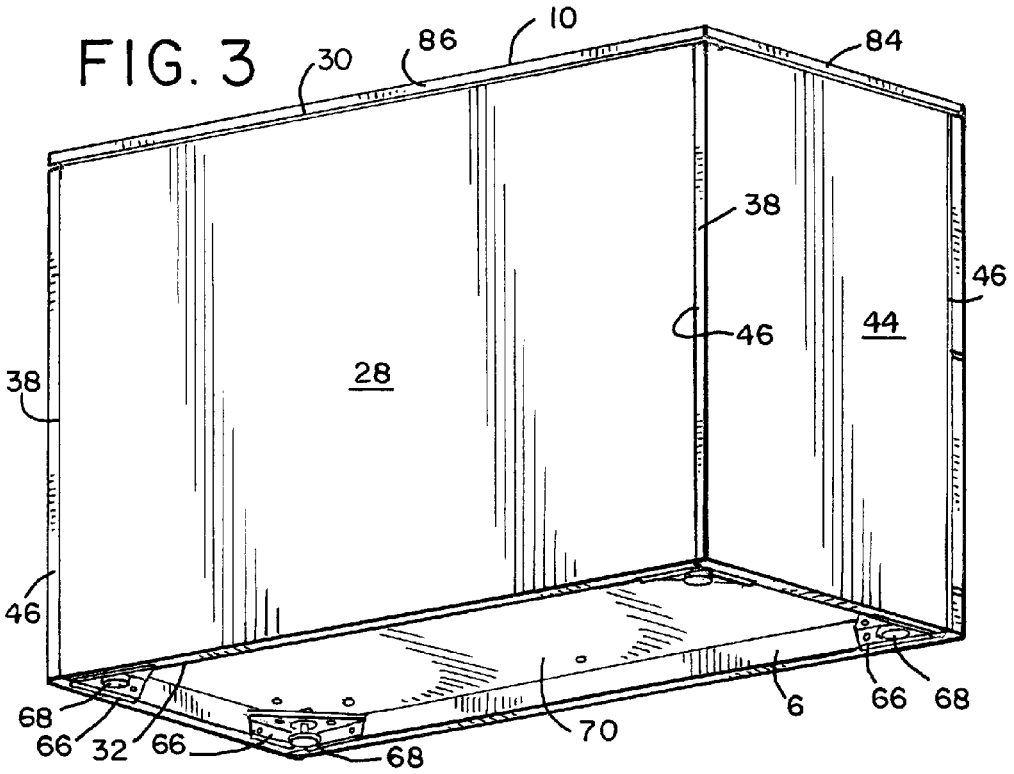
FIG. 3 is a rear/bottom perspective view of the furniture component shown in FIG. 1A.
Figure 4:
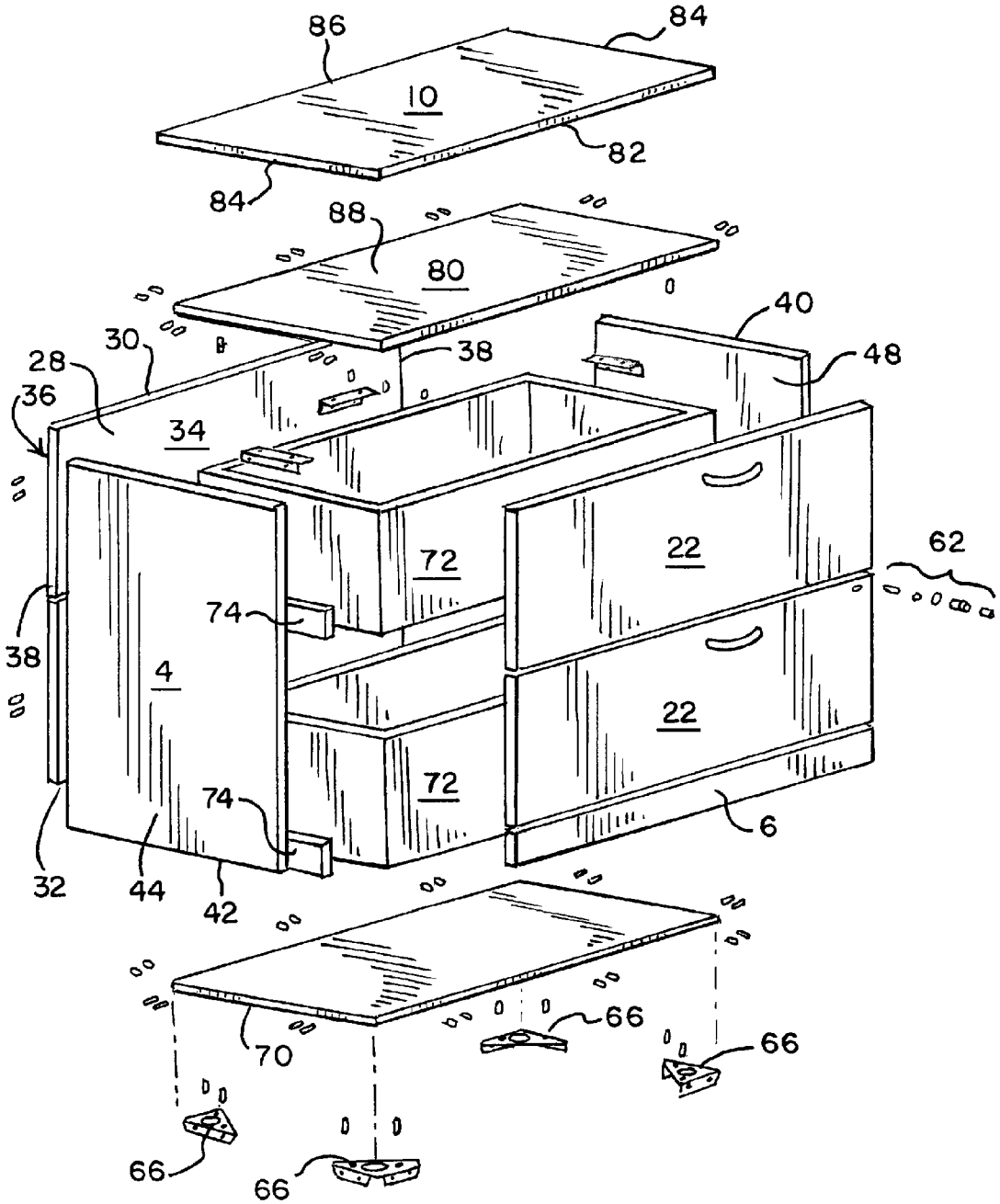
FIG. 4 is an exploded perspective view of the furniture component shown in FIG. 1A.
Figure 5:
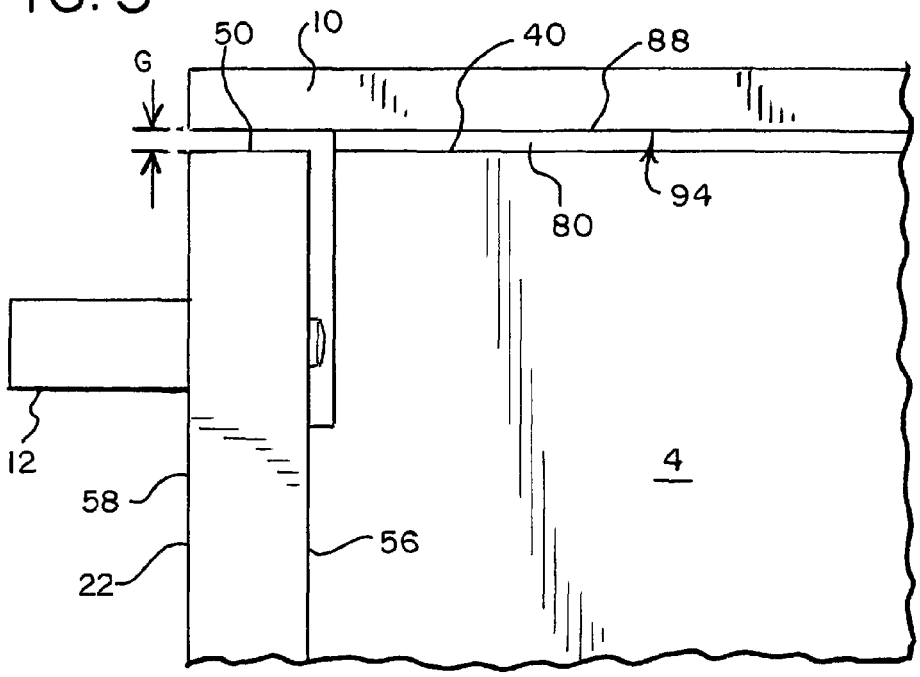
FIG. 5 is an enlarged side view of the front corner of the furniture component shown in FIG. 1A.
Figure 6:
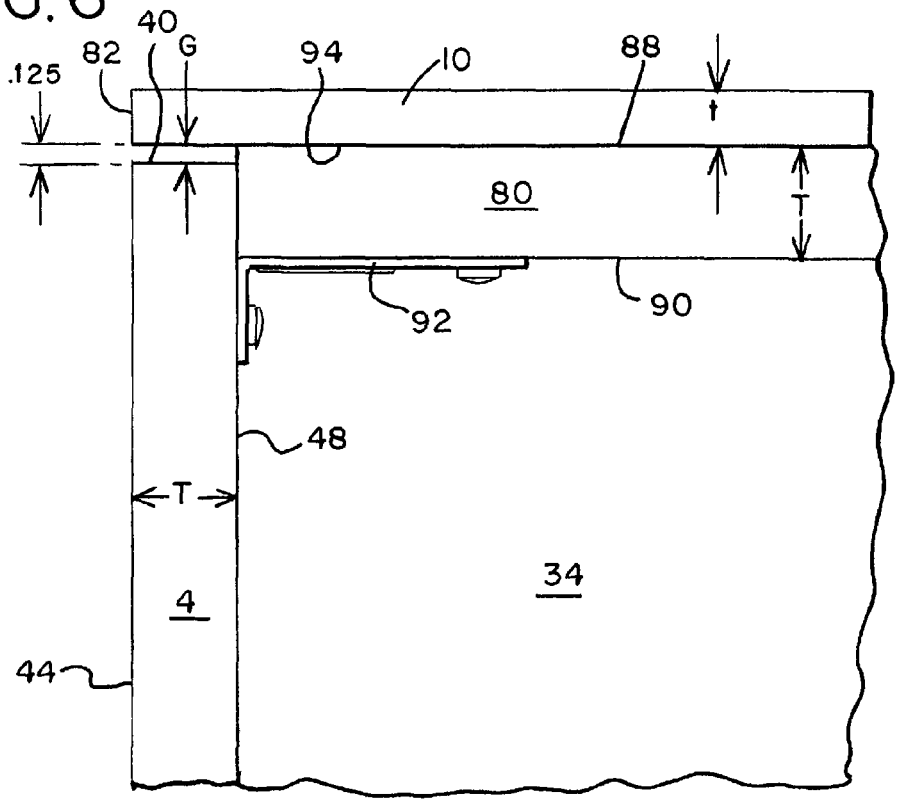
FIG. 6 is an enlarged interior side view of the rear corner of the furniture component shown in FIG. 1A.

Referring to FIGS. 1A, 3 and 4, a furniture component 2 is shown as including a back wall 28, a pair of horizontally spaced side walls 4 and a front wall 22, 6, which form a base. The back wall has upper and lower edges 30, 32, inner and outer vertical faces 34, 36 and opposite side edges 38. Likewise, the side walls 4 each have upper and lower edges 40, 42, inner and outer vertical faces 48, 44 and opposite side edges 46. The front wall may include various panels. For example, as shown in FIGS. 1A and 2-6, the front wall is formed by a pair of drawer fronts 22 and a toe kick panel 6. Each of the front wall panels has upper and lower edges 50, 52, opposite side edges 54 and inner and outer vertical faces 56, 58. In other embodiments, the front wall may include one or more door panels 24 (FIG. 1B), or a peripheral frame 26 (FIG. 1C). The frame may define openings 60, for example for shelves, or for receiving drawer or door panels. In one embodiment, the drawers are each configured with a pull 12, and may include a lock mechanism 62. It should be understood that the furniture component is not limited to the various cabinet embodiments shown, but may be configured as other furniture components, including for example and without limitation as a desk (FIG. 1D) having a knee space 64 formed in the front of the base beneath a top 10.

Referring to FIGS. 1A, 3 and 4, the inner faces 48, 34, 56 of the side walls, back wall and toe kick panel are connected with corner brackets 66 as beast shown in FIG. 3. A plurality of feet 68, which may be vertically adjustable, are secured to each bracket 66. The feet may be configured as glides, casters or other known devices. A bottom wall 70 is also connected to the inner faces of the side walls, back wall and toe kick panel. The side and back walls may be further connected with various brackets and fasteners.

As shown in FIG. 4, a pair of drawers 72, configured as boxes, are slidably mounted on drawer guides 74 fastened to the inner vertical face 48 of the side walls. The drawer fronts 22, or front wall, are then fastened to the front panel of the drawer box 72 with various fasteners. It should be understood that the drawer front may be configured as the front panel of the drawer box.

As shown in FIGS. 1A-C and 2-6, the upper edges 30, 40 of the back and side walls are coplanar. In one embodiment, the upper edge 74 of the uppermost front wall is also coplanar with the upper edges 30, 40 of the back and side walls. In one embodiment, the back, side and front walls may have the same thickness, or substantially the same thickness.

Referring to FIGS. 2 and 4-6, an inner support 80 is connected to the inner faces 34, 48 of the side and back walls with various fasteners. In one embodiment, the inner support is configured as a panel, or inner top. The various side, back, bottom and front walls may be made of various suitable materials, including without limitation a medium density fiberboard (MDF) with a high pressure laminate (HPL) and veneer. Other materials may include solid and wood laminates, plastic, metal and other suitable materials. In other embodiments, the inner support may be configured as one or more brackets (e.g., metal or wood) secured to the side and/or back walls. In these various embodiments, the inner support, including the inner top shown, has an upper surface 88 that is spaced above the upper edges 30, 40, 74 of the back, side and front walls. In one embodiment, the upper surface 88 is spaced less than or equal to about ⅛ inch above the upper edges 30, 40, 74. In other embodiments, the upper surface 88 spaced is spaced less than or equal to about ¼ inch, or less than or equal to about ½ inch. In some embodiments, the minimum gap is about 0.06 inches. A lower surface 90 of the inner top is spaced below the upper edges 30, 40, 74 of the back, side and front walls. A pair of brackets 92, configured in one embodiment as L-shaped brackets, are connected to the lower surface 90 and the inner faces 48 of the side walls to further support the inner top 80.

An outer top 10 has a lower surface 94 supported by and connected to the upper surface 88 of the inner support 80. The lower surface 94 is spaced above the upper edges 30, 40, 74 of the back, side and front walls and forms a visible gap (G) therebetween. In one embodiment, the gap (G) is less than or equal to about ⅛ inch (0.125 inches). In other embodiments, the gap (G) is less than or equal to about ¼ inch (0.25 inches), or less than or equal to about ½ inch (0.50 inches). The outer top 10 has opposite side edges 84 that are coplanar, or substantially coplanar, with the outer vertical face 44 of the side walls, a rear edge 86 that is coplanar, or substantially coplanar, with the outer vertical face 36 of the rear wall, and a front edge 82 that is coplanar, or substantially coplanar, with the outer vertical face 58 of the front wall. For example, in one embodiment, the outer vertical faces are horizontally spaced a maximum of 0.060 inches from the edges of the outer top. In some embodiments, the outer top may extend outwardly on one or more sides, or the on the front or back, such that a corresponding edge thereof is spaced from the outer vertical face thereof. In one embodiment, the outer top has a thickness (t) less than the thickness (T) of each of the side walls, back wall, front wall and inner top. In one embodiment, the thickness (t) of the outer top is about ½ the thickness (T) of the wall components. In other embodiments, the thickness (t) is between about ⅛ and ⅞ the thickness (T) of the other wall components, and in one embodiment between about ¼ and ¾ the thickness (T) of the other wall components. Of course, in other embodiments, the outer top may have substantially the same thickness as, or even a greater thickness than, one or more of the side walls, back wall or front wall. The inner and outer tops may be made of the same materials as the front, side and rear walls.

One method of assembling the furniture component includes connecting the back and side walls 28, 4 with the front toe kick panel 6. The bottom and inner tops 70, 80 may also be connected to the side and back walls, and/or a front wall, such as the toe kick panel. Other front walls may be connected, for example by mounting drawers 22 or a door 24 on the side wall(s), and/or be connecting a peripheral frame 26 to the side walls. In one embodiment, the walls are connected such that the upper edges 30, 40, 74 thereof are coplanar. The inner support, configured in one embodiment as the inner top 80, is then connected to the side and rear walls, and may be connected to the front wall, with the upper surface 88 spaced above the upper edges 30, 40, 74 of the back, side and front walls. The outer top 10 is then secured to the inner support 80, for example with fasteners, adhesive, etc. such that the lower surface 94 thereof is spaced above the upper edges of the rear, side and front walls, but with the edges 82, 84, 86 of the outer top 10 being coplanar with the outer faces 58, 44, 36 of the various wall components. In other embodiments, the inner support and outer top are integrally formed from the piece of material, for example by routing or otherwise machining a peripheral edge of the top to form the bottom surface of the outer top thereof and to define side edges of the inner support which may then be mated with one or more of the side or back walls. In this way, the gap (G) created between the bottom surface 94 of the outer top 10 and the various walls conceals any deficiencies in the shape, form and/or fit of the various walls and the outer top.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A furniture component comprising:

a base comprising a back wall comprising a first outer vertical face, a first inner vertical face and a first upper edge, a pair of horizontally spaced apart side walls each comprising a second outer vertical face, a second inner vertical face and a second upper edge, and a front wall comprising a third outer vertical face and an third upper edge, wherein at least said first and second upper edges are substantially coplanar;

an inner support connected to said back wall and said side walls, wherein said inner support comprises an upper surface vertically spaced above said first and second upper edges and wherein said inner support comprises an inner top spanning an entirety of a distance between said first and second inner vertical faces of said back wall and said side walls respectively, wherein said inner top comprises vertical side edges facing and disposed adjacent to said first and second inner vertical faces of said back wall and said side walls; and an outer top supported by said inner support and comprising a bottom surface spaced above said first and second upper edges and defining a visible gap between said bottom surface and said first and second upper edges, said outer top comprising a rear edge, a pair of horizontally spaced apart side edges and a front edge, wherein said rear edge and said first outer vertical face are substantially coplanar and said side edges and corresponding ones of said second outer vertical faces are substantially coplanar.

2. The furniture component of claim 1 wherein said inner top has a lower surface vertically spaced below said first and second upper edges.

3. The furniture component of claim 1 wherein said outer top is thinner than said inner top.

4. The furniture component of claim 1 wherein said inner support and said outer top are integrally formed as a single piece of material.

5. The furniture component of claim 1 wherein said third upper edge is substantially coplanar with said first and second upper edges.

6. The furniture component of claim 1 wherein said third outer vertical face is substantially coplanar with said front edge.

7. The furniture component of claim 1 wherein said front wall comprises at least one drawer front.

8. The furniture component of claim 1 wherein said front wall comprises at least one door.

9. The furniture component of claim 1 wherein said gap is less than or equal to about an ⅛ inch.

10. A furniture component comprising:

a base comprising a back wall comprising a first outer vertical face, a first inner vertical face and a first upper edge, a pair of horizontally spaced apart side walls each comprising a second outer vertical face, a second inner vertical face and a second upper edge, and a front wall comprising a third outer vertical face and an third upper edge, wherein at least said first and second upper edges are substantially coplanar, wherein said back, side and front walls each have a uniform thickness;

an inner support connected to said back wall and said side walls, wherein said inner support comprises an upper surface vertically spaced above said first and second upper edges and wherein said inner support comprises an inner top spanning an entirety of a distance between said first and second inner vertical faces of said back wall and said side walls respectively; and an outer top supported by said inner support and comprising a bottom surface spaced above said first and second upper edges and defining a visible gap between said bottom surface and said first and second upper edges, said outer top comprising a rear edge, a pair of horizontally spaced apart side edges and a front edge, wherein said rear edge and said first outer vertical face are substantially coplanar and said side edges and corresponding ones of said second outer vertical faces are substantially coplanar, wherein said outer top is thinner than said front wall.

11. The furniture component of claim 10 wherein said outer top is thinner than said side walls.

12. The furniture component of claim 10 wherein said outer top is thinner than said back wall.

13. The furniture component of claim 10 wherein said outer top is about ½ a thickness of at least one of said front wall, said side walls and said rear wall.

14. A furniture component comprising:

a base comprising a back wall comprising a first outer vertical face, a first inner vertical face and a first upper edge, a pair of horizontally spaced apart side walls each comprising a second outer vertical face, a second inner vertical face and a second upper edge, and a front wall comprising a third outer vertical face and an third upper edge, wherein at least said first and second upper edges are substantially coplanar;

a support connected to said back wall and said side walls, wherein said support comprises an upper surface vertically spaced above said first and second upper edges and wherein said support comprises an inner top spanning an entirety of a distance between said first and second inner vertical faces of said back wall and said side walls respectively, wherein said inner top comprises vertical side edges facing and disposed adjacent to said first and second inner vertical faces of said back wall and said side walls; and an outer top supported by said support and comprising a bottom surface spaced above said first, second and third upper edges and defining a visible gap between said bottom surface and said first, second and third upper edges, said outer top comprising a rear edge, a pair of horizontally spaced apart side edges and a front edge, wherein said rear edge and said first outer vertical face are substantially coplanar, said side edges and corresponding ones of said second outer vertical faces are substantially coplanar and said front edge and said third outer vertical face are substantially coplanar.

15. A method of assembling a furniture component comprising:

connecting a back wall to a pair of horizontally spaced side walls, wherein said back wall comprises a first outer vertical face, a first inner vertical face and a first upper edge, wherein each of said side walls comprises a second outer vertical face, a second inner vertical face and a second upper edge, wherein said first and second upper edges are substantially coplanar;

disposing an inner top between said side walls and said back wall, wherein said inner top spans an entirety of a distance between said side walls and said back wall, and wherein said inner top has vertical side edges facing and disposed adjacent to said first and second inner vertical faces;

connecting an inner top to said back wall and said side walls such that an upper surface of said inner top is vertically spaced above said first and second upper edges; and supporting an outer top on said inner top wherein a bottom surface of said outer top is spaced above said first and second upper edges and defines a visible gap therebetween, wherein a rear edge of said outer top is substantially coplanar with said first outer vertical face and wherein a pair of horizontally spaced apart side edges of said outer top are substantially coplanar with said second outer vertical faces.

16. The method of claim 15 further comprising horizontally spacing a front wall from said back wall, wherein said front wall has a third upper edge substantially coplanar with said first and second upper edges and wherein said front wall has a third outer vertical face substantially coplanar with a front edge of said outer top.

17. The method of claim 16 wherein said front wall comprises at least one of a drawer front or a door.

18. The method of claim 16 wherein said outer top is thinner than said front wall.

19. The method of claim 15 wherein said outer top is thinner than at least one of said back wall and said side walls.

20. The method of claim 15 wherein said gap is less than or equal to about an ⅛ inch.

* * * * *